US011259662B2

(12) United States Patent
Sanders et al.

(10) Patent No.: US 11,259,662 B2
(45) **Date of Patent: *Mar. 1, 2022**

(54) SPORTS MEMORABILIA JERSEY HANGER WITH TRANSPARENT BODY FORM AND ATHLETE RELATED IMAGERY

(71) Applicants: Lee Sanders, Winnipeg (CA); Helen Sanders, Winnipeg (CA); David Simpson, Winnipeg (CA)

(72) Inventors: Lee Sanders, Winnipeg (CA); Helen Sanders, Winnipeg (CA); David Simpson, Winnipeg (CA)

( * ) Notice: Subject to any disclaimer, the term of this patent is extended or adjusted under 35 U.S.C. 154(b) by 744 days.

This patent is subject to a terminal disclaimer.

(21) Appl. No.: 15/452,218

(22) Filed: Mar. 7, 2017

(65) Prior Publication Data

US 2018/0042419 A1 Feb. 15, 2018

Related U.S. Application Data

(60) Provisional application No. 62/373,058, filed on Aug. 10, 2016.

(51) Int. Cl.
*A47G 25/14* (2006.01)
*A47F 8/00* (2006.01)

(52) U.S. Cl.
CPC ..... *A47G 25/1407* (2013.01); *A47F 8/00* (2013.01)

(58) Field of Classification Search
CPC .... A47G 25/1407; A47G 25/20; A47G 25/28; A47F 8/00
USPC ..... 223/66, 68
See application file for complete search history.

(56) References Cited

U.S. PATENT DOCUMENTS 2,558,497 A * 6/1951 Rosen ..... A47F 8/02 223/120
2,665,040 A * 1/1954 Reid ..... A47F 8/02 223/68
3,010,225 A 11/1961 Hale
3,205,614 A * 9/1965 Brosk ..... A47G 25/28 223/87

(Continued)

FOREIGN PATENT DOCUMENTS

DE 102011117632 A1 * 5/2013 ..... A47G 25/1407

OTHER PUBLICATIONS

ShirtWhiz, Adjustable Jersey Display Hanger, https://www.shirtwhiz.com.

*Primary Examiner* — Nathan E Durham
(74) *Attorney, Agent, or Firm* — Michael R Williams; Kyle R Satterthwaite; Ade & Company Inc.

(57) ABSTRACT

An apparatus for support and display of a sports memorabilia jersey features a body form having an upper body portion with an outline visually resembling a head, neck and shoulders of a human body, and a transparent facial area comprising a facial likeness or team logo of a particular athlete associated with said sports memorabilia jersey. A method of producing such apparatus includes obtaining a facial image of an athlete associated with said memorabilia jersey, obtaining an outline shape of said facial image at a generally life-size scale, producing the body form with the head, neck and shoulder areas, and applying the facial image onto the head area of the body form such that a perimeter shape of the head area of the body form generally conforms to the outline shape of the facial image.

17 Claims, 4 Drawing Sheets

(56) References Cited

U.S. PATENT DOCUMENTS 3,494,056 A * 2/1970 Elzer ..... G09F 7/002 40/594
4,048,736 A * 9/1977 Castleman ..... B65D 65/40 428/500
D253,447 S * 11/1979 Tully ..... D6/316
4,542,838 A * 9/1985 Perez-Tubens ..... A47G 25/16 223/85
4,563,373 A 1/1986 Barnett
4,739,911 A * 4/1988 Quinn ..... A47F 8/02 223/66
4,805,816 A * 2/1989 Freund ..... A47F 8/02 223/66
4,837,956 A * 6/1989 Dolence ..... B32B 27/08 40/675
5,231,925 A * 8/1993 Roberts ..... B41M 1/06 101/142
5,938,088 A 8/1999 Lam
6,158,828 A * 12/2000 Vacovsky ..... A47F 3/005 312/114
6,182,871 B1 2/2001 Lam
6,629,014 B1 9/2003 Lam
7,296,372 B2 * 11/2007 Clark ..... G09F 1/08 40/322
7,591,097 B2 * 9/2009 Alman ..... A47F 3/005 312/114
9,126,737 B2 9/2015 Pickering
10,286,628 B2 * 5/2019 Timmerman ..... B32B 9/045
2003/0041962 A1 * 3/2003 Johnson ..... B32B 27/08 156/266
2007/0048480 A1 * 3/2007 Lavosky ..... G09F 3/10 428/40.1
2007/0119880 A1 * 5/2007 Fitzgerald ..... A47F 5/0006 223/85
2007/0278365 A1 12/2007 Jackson
2009/0250562 A1 10/2009 Jupitz
2013/0302591 A1 * 11/2013 Timmerman ..... B32B 9/045 428/319.9
2017/0259974 A1 * 9/2017 Fu ..... B65D 85/8043

* cited by examiner

SPORTS MEMORABILIA JERSEY HANGER WITH TRANSPARENT BODY FORM AND ATHLETE RELATED IMAGERY

CROSS REFERENCE TO RELATED APPLICATIONS

This application claims benefit under 35 U.S.C. 119(e) of Provisional Application Ser. No. 62/373,058, filed Aug. 10, 2016, the entirety of which is incorporated herein by reference.

FIELD OF THE INVENTION

The present invention relates generally to apparatuses for display of sports memorabilia jerseys.

BACKGROUND

Conventional means of display sports memorabilia jerseys involve directly hanging the jersey on a wall, or mounting the jersey in a framed box which is then mounted to the wall.

One commercially available product, the ShirtWhiz™, as seen at www.shirtwhiz.com, is a specialized jersey hanger configurable into different shapes to support different jersey types (e.g. baseball, hockey, basketball). While solving the issue of a flexible product adaptable to display different jersey types, the product does not add to the visual aesthetic of the jersey itself.

General garment hangers incorporating facial imagery to augment the display of garments hung thereon are found in U.S. Pat. Nos. 3,010,225, 4,563,373, 5,938,088, 6,182,871 and 6,629,014, none of which deal specifically with display of sports memorabilia jerseys.

U.S. Pat. No. 9,126,737 discloses a storage container having a three-dimensional torso-like shape to impart a three-dimensional character to a jersey placed over the exterior of the container, and including a suction cupped bracket for optional hanging of the container from a vertical surface. U.S. Patent Application Publication 20090250562 discloses a jersey hanger also designs to impart some three-dimensional character to the jersey placed thereon.

U.S. Patent Application Publication US20070278365 discloses a sports memorabilia hanger in the form of a free-standing upright having upper hanger arms and a lower pants hanger, but lacking any visual aesthetic to compliment the memorabilia hung thereon.

Despite these prior attempts to improve on conventional jersey display techniques, there remains room for improved jersey display solutions, in response to which Applicant has developed a unique display apparatus that not only supports the jersey itself, but adds further aesthetic value to the overall display thereof by incorporating a likeness of the professional athlete associated with the particular jersey being displayed.

SUMMARY OF THE INVENTION

According to one aspect of the invention, there is provided a sports memorabilia display apparatus for support and display of a memorabilia jersey, said apparatus comprising a body form comprising an upper body portion, an outline of which visually resembles a head, neck and shoulders of a human body, said upper body portion comprising a facial area comprising a transparent substrate on which there is printed imagery related to a particular sports entity associated with said sports memorabilia jersey.

In one embodiment, said sports entity is a sports team with which said sports memorabilia jersey is associated, and said printed imagery comprises a logo of said sports team.

In another embodiment, said sports entity is an athlete which said sports memorabilia jersey is associated, and said printed imagery comprises a facial likeness of said athlete.

Preferably the transparent material comprises glass.

Preferably the transparent material comprises tempered glass.

Preferably the printed image comprises ceramic ink.

Preferably there is a printed backing layer covering the printed image on a backside of the transparent substrate to reside opposite an unprinted front side thereof from which the printed image is visible.

Preferably there is a security film bonded to the body form.

Preferably there is a hanging bracket affixed to the body form on a rear side thereof for wall-hung support thereof.

Preferably the hanging bracket is hidden behind said backing layer under viewing of the transparent substrate from the unprinted front side thereof.

Preferably the hanging bracket has a same or lighter colour as the backing layer at an adhered side of the hanging bracket affixed to the backside of the planar sheet of transparent material.

According to a second aspect of the invention, there is provided method of producing a sports memorabilia display apparatus for support and display of a sports memorabilia jersey, said method comprising:

obtaining imagery related to a particular sports entity associated with said sports memorabilia jersey;

on a body form comprising an upper body portion having head, neck and shoulder areas, outlines of which visually resemble a head, neck and shoulders of a human body, printing said imagery on a transparent substrate at said head area of the body form.

Preferably the method includes tempering the glass after printing the imagery thereon.

Preferably the method includes bonding a film to the transparent substrate on a same side thereof on which the imagery was printed.

Preferably the imagery is a mirror image of an original photographic image from which the imagery was obtained, and the imagery is printed on a backside of the sheet of substrate material opposite a front viewing side thereof from which the imagery is to be viewed.

Preferably the step of printing said imagery comprises placing a first guide piece into a printing machine, running a first print of the imagery on said guide piece, placing the transparent substrate atop said guide piece in a manner aligning said transparent substrate over the first print of the facial image, and running a second print of the imagery on said transparent substrate.

According to another aspect of the invention, there is provided a sports memorabilia display apparatus for support and display of a memorabilia jersey, said apparatus comprising a body form comprising an upper body portion, an outline of which visually resembles a head, neck and shoulders of a human body, said upper body portion comprising a facial area comprising a facial likeness of a particular athlete associated with said sports memorabilia jersey.

Preferably said facial likeness comprises a photographic image of said particular athlete.

Preferably said facial area of the body form is planar.

Preferably said upper body portion of the body form is planar.

Preferably the body form comprises a planar sheet of transparent material, and said planar sheet of transparent material defines said facial area.

Preferably the facial likeness comprises a printed image on a planar sheet of transparent material.

Preferably the transparent material comprises glass.

Preferably the printed image comprises ceramic ink.

Preferably a printed backing layer covers the printed image on a backside of the planar sheet of transparent material to reside opposite an unprinted front side from which the printed image is visible.

Preferably the backing layer is monochromatic.

Preferably the backing layer is white.

Preferably the planar sheet of transparent material is a tempered sheet of glass.

Preferably a security film is bonded to the planar sheet of transparent material.

Preferably the security film is bonded to a printed side of the planar sheet of transparent material.

Preferably a hanging bracket is affixed to the body form on a rear side thereof for wall-hung support thereof.

Preferably the hanging bracket is mounted behind the backing layer at the backside of the planar sheet of transparent material such that the hanging bracket is hidden behind said backing layer under viewing of the planar sheet of transparent material from the unprinted front side thereof.

Preferably the hanging bracket has a same or lighter colour as the backing layer at an adhered side of the hanging bracket affixed to the backside of the planar sheet of transparent material.

According to yet another aspect of the invention, there is provided a method of producing a sports memorabilia display apparatus for support and display of a sports memorabilia jersey, said method comprising:

obtaining a facial image including a facial likeness of an athlete associated with said memorabilia jersey;

obtaining an outline shape of said facial image at a generally life-size scale;

producing a body form comprising an upper body portion having head, neck and shoulder areas, outlines of which visually resemble a head, neck and shoulders of a human body, and applying said facial image onto the head area of the body form such that a perimeter shape of the head area of the body form generally conforms to the outline shape of the facial image.

Preferably the step of producing the body form includes cutting a planar sheet of substrate material according to said outline shape of the facial image, whereby the sheet of substrate material defines the head area of the body form, and the step of applying said facial image comprises printing said facial image onto the cut sheet of substrate material.

Preferably the sheet of substrate material is transparent.

Preferably the sheet of substrate material is glass.

Preferably the method includes tempering the sheet of glass after printing the image on said sheet of glass.

Preferably the method includes printing the image in ceramic ink.

Preferably the method includes printing a backing layer over the printed image.

Preferably the backing layer is monochromatic.

Preferably the backing layer is white.

Preferably the method includes mounting a hanging bracket to the sheet of substrate material in a position residing behind the backing layer such that the hanging bracket is hidden behind said backing layer under viewing of the sheet of substrate material from a front viewing side thereof opposite a backside thereof at which the image and backing layer are printed.

Preferably the bracket has a self-adhering side of same or lighter colour as the backing layer, and the method comprises affixing the self-adhering side of the bracket to the backside of the sheet of substrate material.

Preferably the method includes bonding a film to the body form on a same side of the substrate material on which the image was printed.

Preferably the facial image is a mirror image of an original photographic image from which the facial image was obtained, the sheet of substrate material is transparent, and the facial image is printed on a backside of the sheet of substrate material opposite a front viewing side thereof from which the image is to be viewed.

Preferably the sheet of substrate material is transparent and the step of applying said facial image onto the head area of the body form comprises placing a first planar guide piece into a printing machine, running a first print of the facial image on said guide piece, placing the cut sheet of substrate material atop said guide piece in a manner aligning said cut sheet of substrate material over the first print of the facial image, and running a second print of the facial image on said transparent sheet of substrate material.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

In brief, the accompanying figures, illustrate a sports memorabilia jersey display apparatus including a body form made of a planar sheet of material cut to resemble a head and shoulder form of the professional athlete associated with the particular jersey to be displayed, suitable wall hanging hardware on a rear side of the sheet for wall mounting thereof, and a photo-realistic facial image of the relevant professional athlete displayed on the facial area of the body form. In the illustrated embodiments, the body form consists solely of an upper body portion outlining the head, neck and shoulders of a human body, but in other embodiments, the body form may include other portions outlining any or all other parts of the human body.

The planar shape of the body form, the incorporated imagery thereon, and the adhered wall hanging hardware provide a simple one-piece construction that mounts generally flush to the wall for minimal obtrusiveness, provides an added level of aesthetic value to the display of the jersey by the incorporation of a photographic likeness of the subject athlete in lifelike proportion to the jersey, and enables easy placement and removal to and from the apparatus, whereby the jersey can be removed and worn as the owner desires, a function that conventional jersey frame boxes do not practically possess.

Greater attention to the structure and manufacture of one preferred embodiment is now presented as follows.

Figure 1:
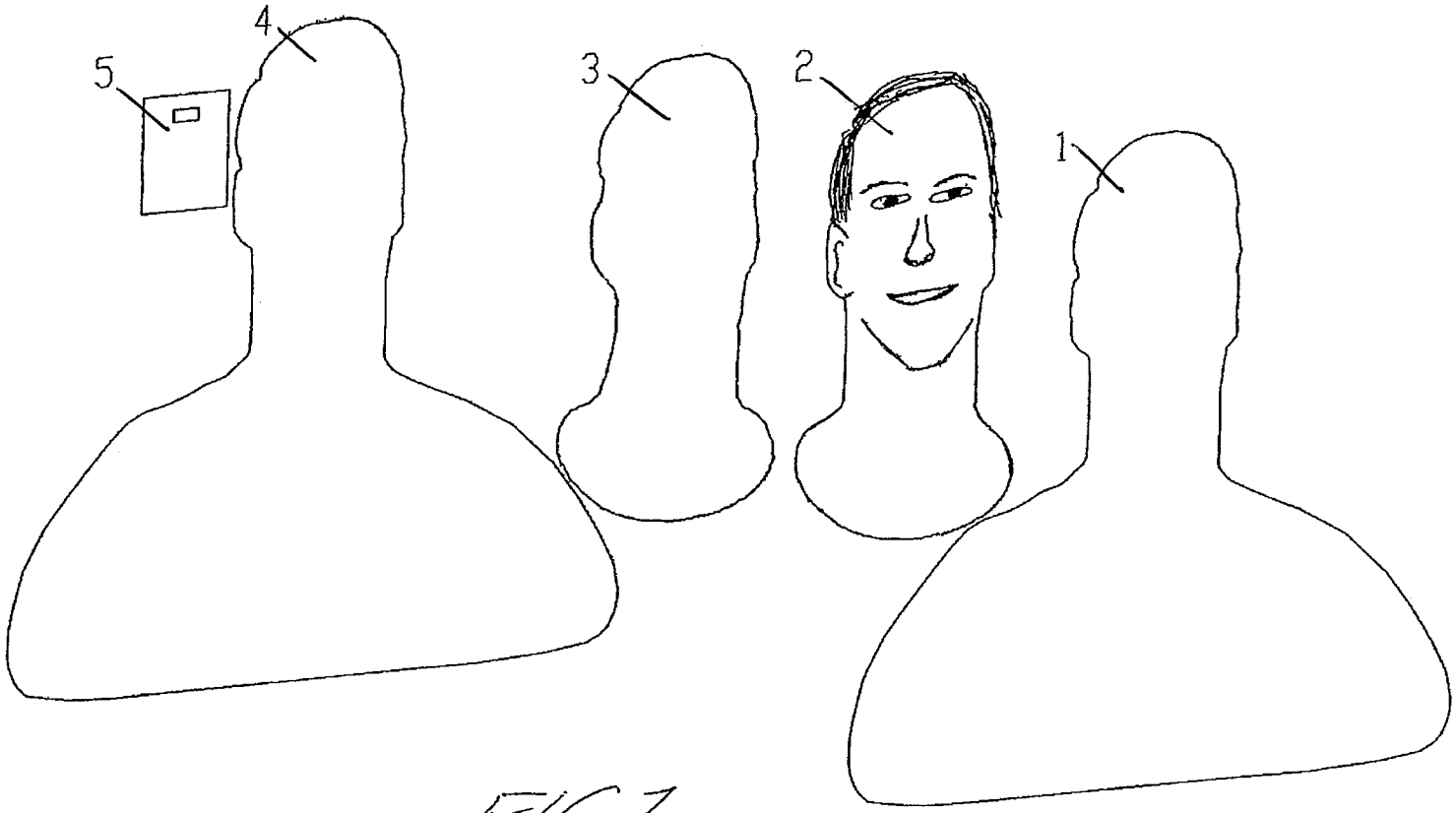
FIG. 1 is a schematically exploded perspective view of a sports memorabilia jersey display apparatus according to a first embodiment of the present invention.
Figure 3:
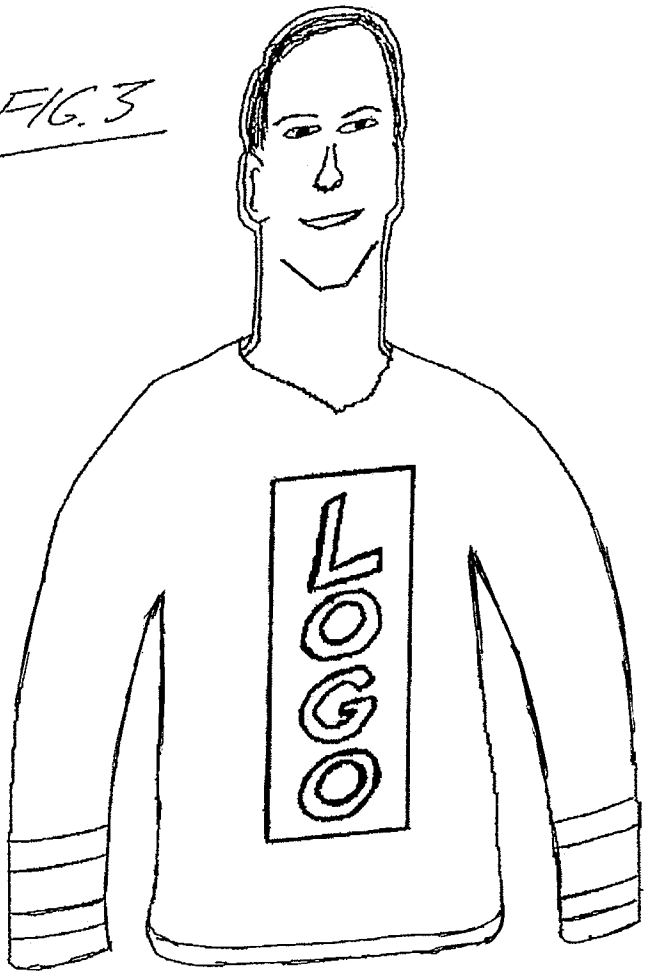
FIG. 3 is an elevational view of the apparatus of FIG. 2 with a jersey displayed thereon.
Figure 2:
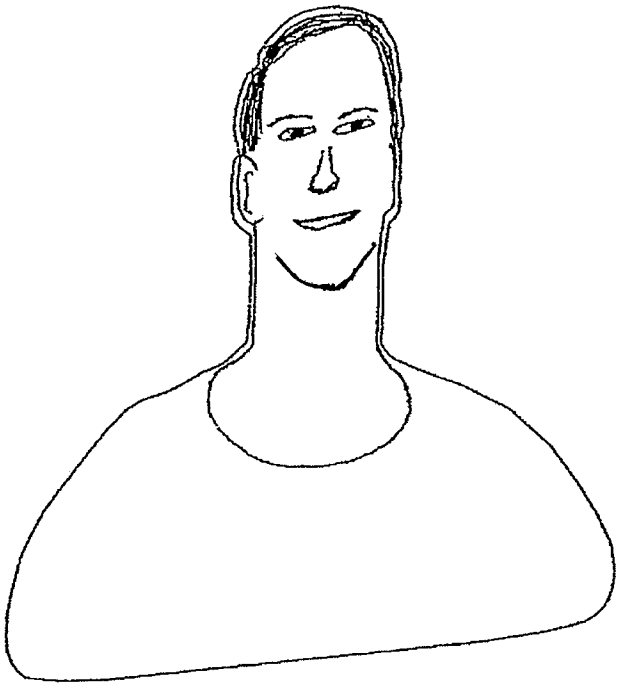
FIG. 2 is an elevational view of the apparatus of FIG. 1 in an installed position hanging on a wall.

With reference to FIG. 1, a sheet of glass 1, for example 6 mm tempered extra clear low iron 6 mm float glass, is custom cut to match to match at least the head shape, and optionally the body shape (not shown), of the subject athlete from an available photographic image of the athlete that has been scaled to a generally life-like size, whereby the sheet of glass serves as both the body form of the apparatus on which the jersey is supported, and the printing substrate to which the athlete imagery has been applied.

A printed image layer 2 of tempered ceramic ink is applied on a backside of the glass sheet 1 (i.e. the side thereof that will face the wall during use of the finished apparatus) and features the facial, and optionally body, image of the subject athlete at the generally life-like scale. The printed image layer 2 may have a thickness of approximately 25 microns, and a minimum resolution of at least 72 DPI.

A printed back-layer 3 of spot white ceramic ink, for example 40 microns thick, is applied over the printed layer 2 on the backside of the glass sheet to control the degree of light transmission through the glass.

A security film 4, for example 175 micron polyester film, is bonded to the backside of the glass sheet to overlie the entirety thereof and thus span over the printed image and backing layers. In the event the apparatus is dropped or impacted with sufficient force to shatter the glass, the security film holds the broken glass together.

Finally, a suitable hanging bracket 5 is adhesively attached to the film-covered backside of the glass sheet in order to enable wall-hanging of the finished apparatus. In one example, the hanging bracket 5 is a flat steel plate measuring 100 mm by 100 mm square and having a 9 kg support weight capacity, with a thin-foam laminate and self-adhesive layer on the front side of the plate and a punched out strip or hole near the top edge thereof to receive a standard wall hook or screw. The adhesively coated and foam-padded front side of the hanging bracket 5 is adhered to the backside of the glass in a position hidden behind the backing layer 3, whereby the backing layer visually conceals the bracket from sight when the apparatus is viewed from the opposing front side of the glass sheet. The extra backing layer reduces light transmission through the image layer at areas around the bracket to prevent appearance of a darkened area or shadow in the image at the area covered by the bracket. While this function may be accomplished using backing layers of non-white colour, use of white for the backing generates a crisper image than using another color/shade.

Turning attention to the materials that may be employed to produce the apparatus, the glass sheet may be extra clear low Iron 6 mm float glass—Extra clear low iron glass contains approximately one quarter of the iron content of standard clear float glass, providing an extra clear glass that is crystal clear in appearance.

In preferred embodiments, tempered glass is used for optimal safety and strength. Tempered glass is a type of safety glass processed by controlled thermal treatments to increase its strength compared with normal glass. Tempering puts the outer surfaces into compression and the inner surfaces into tension. Such stresses cause the glass, when broken, to crumble into small granular chunks instead of splintering into jagged shards, as would be created by plate glass when broken. The granular chunks are less likely to cause injury.

Where glass is used as the body form and printing substrate, ceramic ink is preferably employed for the printed image and backing layers. Such inks are made of ceramic frit (a mixture of silica and fluxes) and inorganic pigments and elements. Ceramic inks are tempered to fuse the inks with the glass. Due to the extreme temperatures of this process there is first a decomposition of organic additives and binders of the ink. Next there is a fusion of the frit to the substrate and pigments followed by the expulsion of voids to give a compacted structure. Lastly there is a formation of a surface with the desire properties. A successful tempering of the glass and ceramic ink will result in a bubble free layer of constant thickness and homogeneous pigment dispersion within the glass.

To produce the apparatus using the preferred digital ceramic printing on a glass substrate, the following equipment may be used.

Glass-accommodating cutting tables are used for the supporting and cutting of glass sheets, which may measure 3300×2440 mm in their original pre-cutting form. The table provides a large, flat, horizontal surface, covered with carpet, for supporting a glass sheet in position for scoring on its top surface by a glass cutter. In the context of the present application, these initially large sheets of glass can be pre-cut into smaller rectangular pieces suitable for receipt in the CNC machine, which then performs the more complex athlete-shaped cutting process.

A CNC (computer numerical controlled) machine with suitable glass cutting tooling is preferably used due to the complex cut-out shapes involved in producing a human form that will vary from one athlete to the next. Such CNC machines can perform the task of cutting glass in virtually any two dimensional shape, and can achieve various types of edgework.

A stainless steel glass-washing machine may be employed, for example in the form of a commercially available unit compatible with glass thicknesses of 3-19 mm, and having automatic cleaning and drying with eight brushes and four air knives for drying, complete with temperature control and a variable speed conveyor.

A digital ceramic ink printer is typically a flatbed digital printer designed with print heads to jet ceramic inks directly onto the glass. The glass remains stationary while the printer carriage sweeps across the print table. A key feature of the printer is drop fixation in which ink droplets are dried immediately to prevent drop gain. The fixation of the ink enables a single pass of the print carriage even when printing multi-colour files. The high resolution print quality—for example up to 720 dpi—and the precision of the printers allow glass processors to print anything from fine, sharp, small elements to complex full color images on glass.

For safety reasons, a tempering furnace is preferably employed, for example in the form of a flat run furnace that heats the glass up to a suitable target temperature (e.g. 690 Fahrenheit) for tempering the glass. The tempering process joins the ceramic ink with the glass substrate making it part of the glass becoming fade-free and virtually scratch resistant. The tempering process makes the glass stronger and also makes the resulting glass particles less dangerous to people in the event of breakage.

Suitable image processing software, for example Adobe Photoshop, is used to reformat the image information into a format the printer can utilize and is also employed as a design tool for preparing the image file for printing. The software calculates ink usage to control levels of translucency and opacity, to control color matching and mixing, and to compensate for different glass sizes and thicknesses. The precision and complexity of the calculations and measurements executed by the software allows designers can achieve their desired outcome.

Having described suitable materials and equipment useful in production of the sports memorabilia jersey display apparatus of the preferred embodiment, attention is now turned to the manufacture of same using such materials and equipment.

Initial facial imagery of the subject athlete can be captured in any format, but needs to be converted to an electronic file of suitable specification for the generally life-size scale of the intended application, for example with a minimum image size of 2500×2500 pixels and minimum resolution of 72 dots per inch (dpi). Three hundred dpi is a preferred minimum in some embodiments. The facial image needs to be in the correct orientation so that when printed and paired with the jersey, it looks anatomically correct.

Accordingly, once a source image file with a suitably oriented facial image of the subject professional athlete is selected, the file is opened in the image processing software and the source image is resized as appropriate, preferably with a resample option selected if available, in order to maintain as much detail as possible within the resized image. Sizing of the image needs to be completed so that the printed image on the body form, when a jersey is placed over the shoulders thereof, creates a proportional representation of the head and shoulders of the athlete when compared with the jersey. Generally, if the image is in the correct orientation, an iris diameter of 12 mm will create this generally life-size proportion in the final printed image. If the printed iris will measure 12 mm, the neck will typically measure approximately 150 mm, or slightly less, for an average body size.

Next, any background imagery from around the image of the subject athlete is removed, and this athlete-surrounding area of the source image is made transparent. Likewise, any undesired areas of the subject athlete's body not intended for use in the final image to be printed on the jersey display apparatus are removed and made transparent. In the scenario of the illustrated embodiment, where only the neck and head of the athlete are printed, all other colour with the exception of the face and neck is also removed and made transparent.

Still using the image processing software, appropriate skin tone colour is applied to the neck and torso as required to ensure there will be no clear glass visible in the final display apparatus at areas thereof left uncovered by the jersey when worn over the shoulders of the body form. The appropriate skin tone is used to ensure an unnoticeable transition from the original facial imagery to the altered upper torso portion of the edited image, where a shirt, jersey or other piece of clothing worn by the athlete in the source image is covered up or removed and replaced with skin tone so that the clothing in the original source image is not printed on the body form.

A clipping mask is then generated around the edited image area containing the face, neck and upper torso, and this edited image is exported to a CAD compatible format (e.g. AutoCAD's DXF interchange file format), whether directly from the image processing software used to edit the original image, or via an intermediary program (e.g. Adobe Illustrator) if direct export to the CAD format is not possible from the editing software.

In the CAD program, the outline shape of the converted image is traced with a polyline tool, with as much detail as the CNC machine will allow for radius generation. This polyline is then offset outwardly from the traced image outline, for example by 3 mm. This represents a margin size by which the glass cutout should exceed the size of the image to be printed thereon. A torso template of standardized shoulder shape and torso size may be saved as a block template that can be pulled up in the CAD software during creation of any particular body form. Once the polyline has been traced from the edit face and neck image, the torso template is then inserted and joined to the head and neck polyline at the lowest portion of the neck. A trim tool of the CAD program is used to remove unnecessary line work once the torso block and head/neck polyline are matched up. The overall outer shape of the now joined head, neck and torso patterns is then mirrored and exported to the CNC machine for cutting. The shape needs to mirrored, so that when the edited athlete image is mirrored in the print-file generation process, the CNC cutting shape and the athlete image match. As the image is best viewed from the unprinted side of the glass sheet, the image is mirrored in the print-file generation and printed on the backside of the glass.

The glass is then cut to the prescribed shape on the CNC machine. In the case where extra clear low iron float glass is used, the air side of the glass will result in a better qualify image versus printing on the tin side. Accordingly, if the glass is placed air side up in the CNC machine, the forgoing mirroring of the toolpath pattern is necessary to ensure that the cut shape of the glass will match the printed image. Alternatively, if the glass is cut tin side up in the CNC machine, the mirroring step during creation of the toolpath can be omitted. Identification of the air side versus the tin side of the glass can the determined via an ultraviolet lamp tin side detector.

Once the edited image is suitable with respect to orientation, size and colour, it can be extracted through custom ripping software. Ripping is the process of reformatting the image file into a format the destination printer will be able to utilize to print the image. It contains tiff files for each ink colour and log files for the software. As mentioned above, the image needs to be mirrored before ripping to produce the correct image when viewed from the unprinted side of the glass sheet (i.e. the side thereof that faces away from the wall in the installed wall-hung position of the jersey display apparatus).

Once the edited neck/face colour image has been reformatted, the backing image of matching shape to the edited neck/face colour image also needs to be generated in white (spot colour). This matching white layer will be utilized to for a second print on top of the colour neck/face image to create the aforementioned backing layer. The white layer is printed to improve colour quality and prevent the hanging bracket from being visible form the viewing side (unprinted front side) of the glass. The white spot colour layer also needs to be mirrored, reformatted via ripping software, and oriented so that it is printed exactly on top of the colour image.

As a conventional ceramic ink printer is designed to handle rectangular or square pieces of glass, a complicated shape such as a torso and head generates an unprintable piece of media for the printer. For this reason a piece of rectangular glass needs to be placed on the printer, with the head and torso shaped glass (i.e. the cut glass) placed on top for printing. The rectangular glass underlying the cut glass thus serves as a jig or guide to accomplish appropriate placement of the irregularly shaped cut glass in the printer. To ensure proper alignment of the cut glass with the printer, a first print run of the finished face/neck athlete image is performed on the square glass and allowed to dry. Once this first print on the rectangular glass has dried, the head and torso shaped glass is placed over the already-printed rectangular glass, for example by seating the cut glass atop a set of clear plastic buttons or spacers placed on the dried print of the underlying rectangular glass. The cut glass is placed in in the correct location so that the final print on the cut glass will be produced with an even offset or margin of glass around the head portion of the printed image. Optimal print quality requires that the glass is completely clean and the print room is dust free, as any minerals, oil, dust, and/or water on the glass will produce unacceptable print quality.

At this stage, the edited face/neck image of the athlete is printed again, this time on the cut glass seated atop the previously printed square glass, and this second print is inspected for quality assurance and allowed to dry. Once dry, the backing layer of the spot colour white is printed over the colour athlete image in the correct orientation so that there is no white visible from the glass/viewing side. That is, the white backing layer is fully covered by the colour athlete image on viewing of the cut glass from the unprinted front side thereof.

The athlete-shaped printed glass piece is then tempered, for example at approximately 690 degrees Fahrenheit. The tempering process produces two desired results, baking the ceramic frit into the glass so it is becomes an integral part of the glass sheet, and producing a tempered glass product for safety purposes. If the display hanger were to break, the resulting glass needs to fall as small "pebbled" pieces to prevent significant injury to people.

The self-adhesive security film is then laid over entire surface of the athlete-shaped glass on the printed backside thereof. The hanging bracket is then installed by placing its preferably white, self-adhering side to the film-covered backside of the athlete shaped glass piece in the correct location to produce a properly balanced, centered display when hanging on the wall.

The resulting product is now ready for delivery to a retailer, distributor or consumer. The consumer simply places their team jersey over the head and neck of the body form so that the jersey drapes over the upper torso from the shoulders of the body form, and hangs the apparatus on the wall using a conventional nail, screw, wall hook or other fastener. To remove the jersey from the apparatus, one simply withdraws the apparatus from off the wall screw or hanger, and pulls the jersey upwardly off the body form, which can be hung back up on the wall.

As an alternative to wall-hung embodiments, stand-up jersey displays may similarly produced, where the body form further includes a lower portion (optionally cut to the general shape of a lower torso and legs) reaching downwardly from the upper torso to a suitable base for supporting the body form upright on the ground, floor or other horizontal surface. While the preferred embodiments employ a glass sheet to define the entirety of the body form, other embodiments may using ceramic printed glass for the head and neck areas for the resulting high quality facial imagery, while using other elements to form the jersey-hanging shoulder area and other torso areas that are concealed under the jersey during use of the display. Also, rigid or semi-rigid printing substrates other than glass may also serve the dual purpose of a planar body form and facial-image support custom cut to the shape of the subject athlete. The subject athlete will typically that whose player number and team matches that of the particular jersey concerned, though a consumer could opt to hang any jersey on a display apparatus having a particular famous athlete's facial likeness thereon.

The printing of facial imagery of the subject athlete onto the printed wall-facing rear side of a glass or other transparent substrate provides the finished product with a dramatically more vibrant, lifelike appearance due to the resulting back-lit effect where light, whether ambient lighting of the given environment or dedicated lighting from a particular light source strategically placed behind the body form, transmitted through the transparent film permeates through the printed layers and continue onward through overlying transparent body form, providing a lifeness to the facial image not obtainable with conventional printing techniques on opaque substrates.

Figure 4:
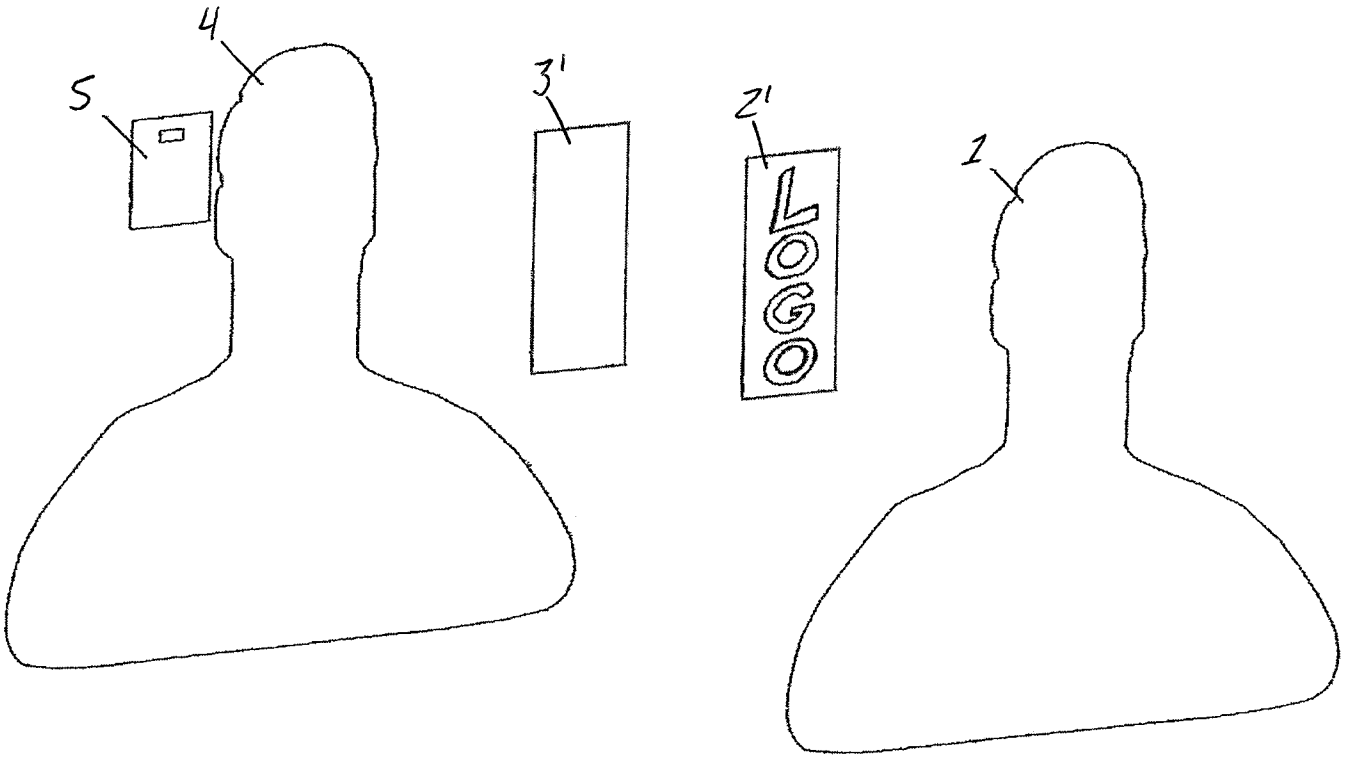
FIG. 4 is a schematically exploded perspective view of a sports memorabilia jersey display apparatus according to an alternate embodiment of the present invention.
Figure 6:
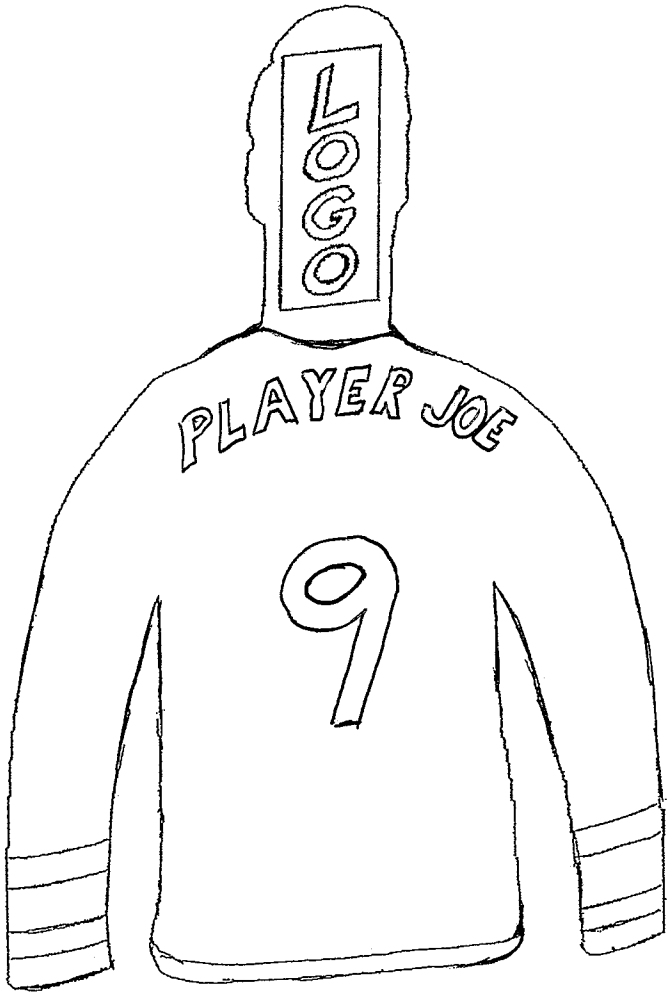
FIG. 6 is an elevational view of the apparatus of FIG. 5 with a jersey displayed thereon.
Figure 5:
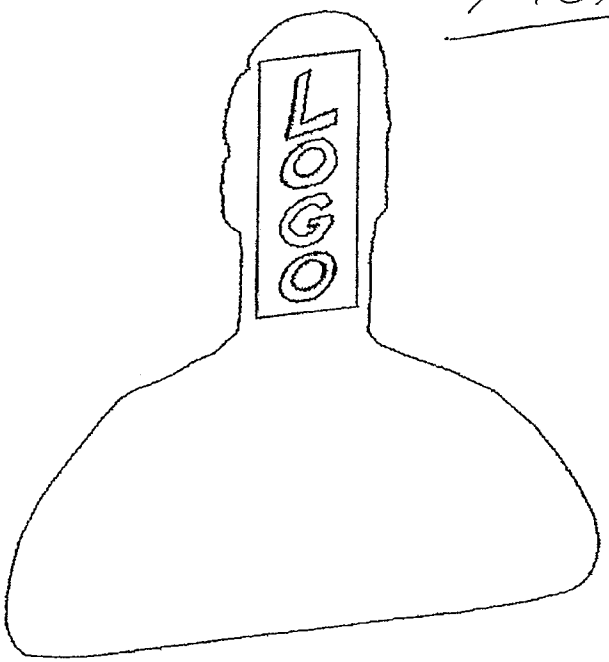
FIG. 5 is an elevational view of the apparatus of FIG. 4 in an installed position hanging on a wall.

FIGS. 4 through 6 illustrate an alternate embodiment in which instead of a facial image of a particular jersey's subject athlete, the facial area of the transparent glass body form instead has a team logo or emblem printed thereon that matches the team of the subject athlete. This alternative embodiment can optionally be marketed as lower-cost alternative that can be produced more cost-efficiently by not having to custom-cut the body form cut according to the facial shape of a particular player. Accordingly, this embodiment can be produced using a standard blank, i.e. pre-cut substrate of standard non-customized shape, requiring no custom cutting according to which particular athlete or team the customer's jersey is associated with. Except for the lack of custom cutting of the body form, this embodiment is produced in the same manner as the first embodiment, and thus has the same general overall structure. That is, the present embodiment has a player-related image (team logo) printed on the backside of the glass substrate, a backing layer printed over the team related image, a safety film bonded over the backing layer, and a hanging bracket installed over the film.

The terms logo and emblem are used interchangeably herein, and encompass any imagery readily recognizable as being associated with the team concerned, including a printed name of the team, whether in stylized or plain text, a recognizable graphic or badge associated with the team, a drawing or photo of a team mascot, or any combinations thereof. In the second embodiment, where a team logo is printed on the body form, the particular logo selected need not be specifically dependent on a particular player associated with the jersey that the end user intends to hang on the apparatus, meaning that a generic (i.e. non player specific) team jersey could be hung on the apparatus, in which case it is the particular team associated with the jersey that determines what logo is selected for printing on the body form, not a particular player/athlete. Accordingly, the term sports entity is used herein to encompass both a sports team and an individual player/athlete. Similarly, in the facial-image embodiment, the particular facial likeness need not be dictated solely by a particularly athlete whose player-specific jersey is to be hung on the apparatus by the end user, as for example, the apparatus may be intended for use with a generic team jersey, in which the case the customer can select the facial likeness to be printed from any current or former member of the team concerned.

In the logo-based embodiment, the same back-lit effect at the image-displaying facial area of the body form is achieved as for the facial image embodiment, thereby providing a vibrancy to the team logo image unparalleled by conventional opaque-substrate printing techniques. Likewise, same material and production efficiency is achieved by printing directly on a planar transparent substrate that singularly, integrally and seamlessly defines the entirety of the body form, thus avoiding the need to assemble the body form from multiple parts of various shape, configuration and/or material. While the forgoing embodiments employ printing of a mirror-image of the team/player related imagery (e.g. athlete's facial likeness, or team logo) on the backside of the body form with an overlying backing layer, other embodiments may alternatively employ printing of a non-mirrored image on the front display side of the body form, though the application of the backing layer on a back-printed image will provides better quality optics in the final product.

As shown in FIG. 6, the logo-based embodiment is particularly effective in instances where the end-user hangs the jersey backwards with the player name and player number facing forwardly from the display apparatus in the same direction as the logo printed on the facial area of the body form. The logo on the display apparatus thus completes the display by adding the logo that would otherwise be absent, since the team logo of the jersey is typically present only on the front of the jersey, whereas a player-specific memorabilia jersey is typically hung backward to display the player name and number.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A sports memorabilia display apparatus for support and display of a memorabilia jersey, said apparatus comprising a body form comprising an upper body portion, an outline of which visually resembles a head, neck and shoulders of a human body, said upper body portion comprising a facial area comprising a transparent substrate on which there is printed imagery related to a particular sports entity, wherein a printed backing layer covers the printed image on a backside of the transparent substrate in opposing relation to an unprinted front side thereof from which the printed image is visible, a hanging bracket is mounted at the backside of the transparent substrate and is fully hidden behind said backing layer under viewing of the transparent substrate from the unprinted front side thereof, and the hanging bracket has a same or lighter colour as the backing layer at an adhered side of the hanging bracket affixed to the backside of the transparent substrate to prevent darkening of the printed image by said adhered side of the hanging bracket.

2. The apparatus of claim 1 wherein said sports entity is a sports team, and said printed imagery comprises a logo of said sports team.

3. The apparatus of claim 1 wherein said sports entity is an athlete, and said printed imagery comprises a facial likeness of said athlete.

4. The apparatus of claim 1 wherein the transparent material comprises glass.

5. The apparatus of claim 1 wherein the transparent material comprises tempered glass.

6. The apparatus of claim 1 wherein the printed image comprises ceramic ink.

7. The apparatus of claim 1 comprising a security film bonded to the body form.

8. The apparatus of claim 1 wherein the backing layer is configured to allow light transmission therethrough, and onward through the printed image and transparent substrate, from the backside of the transparent substrate.

9. The apparatus of claim 1 wherein the printed backing layer is white.

10. The apparatus of claim 1 wherein the printed backing layer is of matching shape to the printed image.

11. The apparatus of claim 10 wherein the printed backing layer is fully covered by the printed image when viewed from the unprinted front side of the transparent substrate.

12. A sports memorabilia display apparatus for support and display of a memorabilia jersey, said apparatus comprising a body form comprising an upper body portion, an outline of which visually resembles a head, neck and shoulders of a human body, said upper body portion comprising a facial area comprising a transparent substrate on which there is printed imagery related to a particular sports entity, wherein a printed backing layer covers the printed image on a backside of the transparent substrate to reside opposite an unprinted front side thereof from which the printed image is visible, the backing layer is configured to allow light transmission therethrough from the backside of the transparent substrate, and onward through the printed image and transparent substrate, and the printed backing layer is fully covered by the printed image when viewed from the unprinted front side of the transparent substrate.

13. The apparatus of claim 12 wherein the printed backing layer is white.

14. The apparatus of claim 12 wherein the printed backing layer is of matching shape to the printed image.

15. A sports memorabilia display apparatus for support and display of a memorabilia jersey, said apparatus comprising a body form comprising an upper body portion, an outline of which visually resembles a head, neck and shoulders of a human body, said upper body portion comprising a facial area comprising a transparent substrate on which there is printed imagery related to a particular sports entity, wherein a printed backing layer covers the printed image on a backside of the transparent substrate to reside opposite an unprinted front side thereof from which the printed image is visible, the printed backing layer is of matching shape to the printed image, and the printed backing layer is fully covered by the printed image when viewed from the unprinted front side of the transparent substrate.

16. The apparatus of claim 15 wherein the backing layer is configured to allow light transmission therethrough, and onward through the printed image and transparent substrate, from the backside of the transparent substrate.

17. The apparatus of claim 15 wherein the printed backing layer is white.

* * * * *